United States Patent [19]

Klob

[11] Patent Number: 4,768,236

[45] Date of Patent: Sep. 6, 1988

[54] SPORTSWEAR HAVING DETACHABLE TOWELLING MEANS

[76] Inventor: Terry A. Klob, 6220 SW. 3rd St., Plantation, Fla. 33317

[21] Appl. No.: 50,083

[22] Filed: May 15, 1987

[51] Int. Cl.[4] ..... A41D 1/06

[52] U.S. Cl. ..... 2/227; 2/238; 2/237; 2/DIG. 6; 2/115

[58] Field of Search ..... 2/227, 238, 237, DIG. 6, 2/279; 15/209 R

[56] References Cited

U.S. PATENT DOCUMENTS 3,760,461 9/1973 Wright ..... 2/DIG. 6
4,224,712 9/1980 Black et al. ..... 2/279 X
4,403,366 9/1983 Lucke ..... 15/209 R
4,599,750 7/1986 Rahaman ..... 2/227 X

*Primary Examiner*—H. Hampton Hunter
*Attorney, Agent, or Firm*—John H. Faro

[57] ABSTRACT

Sportswear having readily accessible towelling means which are detachably and invisibly anchored to the waistband of the garments is disclosed. The preferred garment design is for tennis shorts which includes at least one, and preferably two, quick-release Velcro-like fasteners, one at the waistband and optionally, a second one at the cuff line of the shorts. In both instances, these fasteners are incorporated into the garment so as to be essentially invisible when not in use to retain the towelling means. In another of the preferred embodiments of this invention, sleeve towels are releasably attached, in an analogous manner, to an athletic shirt or jersey.

6 Claims, 2 Drawing Sheets

SPORTSWEAR HAVING DETACHABLE TOWELLING MEANS

BACKGROUND OF THE INVENTION

1. Field of the Invention

This invention relates to an article of manufacture. More specifically, this invention is directed to improved sportswear and athletic apparel having towelling means invisibly and detachably connected to the garment (preferably at the waistband), so as to make it readily accessible during play.

2. Description of the Prior Art

The provision of a towel, or towel-like material, as an accessory or component of sports apparel is well established in the prior art.

The need for such an accessory does not have to be belabored. Anyone who has ever watched or participated in football, tennis or baseball fully appreciates the necessity for maintaining the dryness of one's hands and/or the ball, racquet or bat. Typically, the participant in the sporting event will use a towel, or his uniform to dry his hands and/or his equipment.

In order to lend a degree of convenience to the sportsman, towel-like accessories have been designed to attach directly to the apparel and/or the apparel itself modified to incorporate the towelling material. The following patent literature is representative of past attempts at satisfying the needs and requirements of the sportsman for an accessible towelling accessory: U.S. Pat. Nos. 3,760,461; 4,224,712; and 4,403,366.

These patents are now discussed in greater detail to afford a better understanding of the deficiencies in the prior art.

U.S. Pat. No. 3,760,461 (to Wright), describes and claims a garment (i.e. tennis shorts) having a quick-release towel attached by a Velcro-like fastener to the rear of the shorts just below the waistband of the garment. The Velcro-like fastener is permanently attached to the garment and clearly visible once the towel has been removed. Thus, the garment appears somewhat unfinished, or incomplete, in the absence of the towel. When the towel has been removed, the garment's attractiveness is substantially impaired. Since the garment is not aesthetically attractive where the towel has been removed, the usefulness of the apparel is unnecessarily limited.

U.S. Pat. No. 4,224,712 (to Black, et al) describes and claims a towel having a tab assembly extending from one end of the towel. This tab can be tucked behind the belt at the waistline of the user. The tab can be placed at virtually any location along the waistline which is accessible to the user. The means for retention of the towel is, however, limited exclusively to the pressure contact between the belt line of the garment and the snugness and fit of the garment relative to the wearer. U.S. Pat. No. 4,403,366 (to Lucke) describes and claims what can best be described as a combination of the concepts of the Wright and Black, et al patents. The Lucke configuration includes a belt clip having a Velcro-like gripper and a towel with a complimentary Velcro-like loop. The belt clip can be positioned by the user (sportsman) along the waistband of the garment at any convenient and accessible location. What is, however, apparent is that an attempt at removal of the towel from the clip will probably also result in displacement of the clip from the waistband of the garment. This will, of necessity, interrupt the flow of play since the sportsman will have to reposition the belt clip prior to reattachment of the towel.

As is evident from the foregoing discussion, past attempts at providing convenient and accessible towelling means as accessories to athletic apparel have been rather simplistic and essentially utilitarian in appearance. Where the attachment for the towel accessory is incorporated directly into the garment, it has been placed in a rather conspicuous place and, thus, has resulted in detraction from the garment's overall appearance, where the towel has been removed. The other expedient to which have addressed this problem are also deficient in one or more respects. Accordingly, there still exists a need to provide an effective and accessible towelling accessory for sports apparel which is not only complimentary to the appearance of the garment when (in place) but yet does not detract from the appearance of the garment when removed.

OBJECTS OF THE INVENTION

It is the object of this invention to remedy the above as well as related deficiencies in the prior art.

More specifically, it is the principle object of this invention to provide sportswear and athletic apparel having detachable towelling means which is complimentary to the overall appearance of the garment.

It is another object of this invention to provide sportswear and athletic apparel which incorporates essentially invisible gripper means for connecting a detachable towel to a garment.

It is yet another object of this invention to provide sportswear and athletic apparel which retains its stylish and attractive appearance both when the towel is in place and when it has been removed from the garment.

SUMMARY OF THE INVENTION

The above and related objects are achieved by providing sportswear/athletic apparel having a waistband or shoulder seam, a portion of which has been modified to which define a concealed pocket. The interior of this pocket is provided with Velcro-like gripper means to engage and retain the complimentary loops which have been permanently affixed to a towel at one end thereof. Accordingly, the end of the towelling means having these complimentary loops is simply inserted into this concealed pocket and contacted with the gripper means. In the preferred embodiments of this invention, the towelling means is provided with a tab at or near one end thereof, and the complimentary loop attached to this tab. The towelling means is, thus, maintained in position and readily accessible during sporting activities. It may thereafter be removed for laundering and/or replaced with a dry/clean equivalent, or one having a different fashion appeal (i.e. different color or insignia). In the event the sporting apparel is to be worn off the playing field, the towelling means can be readily removed and the concealed pocket resealed. The existence of the gripper means within the concealed pocket is, thus, not apparent to the casual observer and accordingly does not detract from the tasteful appearance of the garment.

DESCRIPTION OF THE INVENTION INCLUDING PREFERRED EMBODIMENTS

Figure 1:
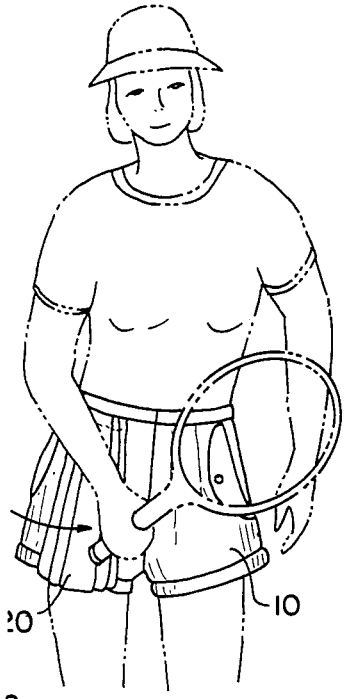
FIG. 1 is a perspective view of sporting apparel of this invention in the form of tennis shorts.
Figure 2:
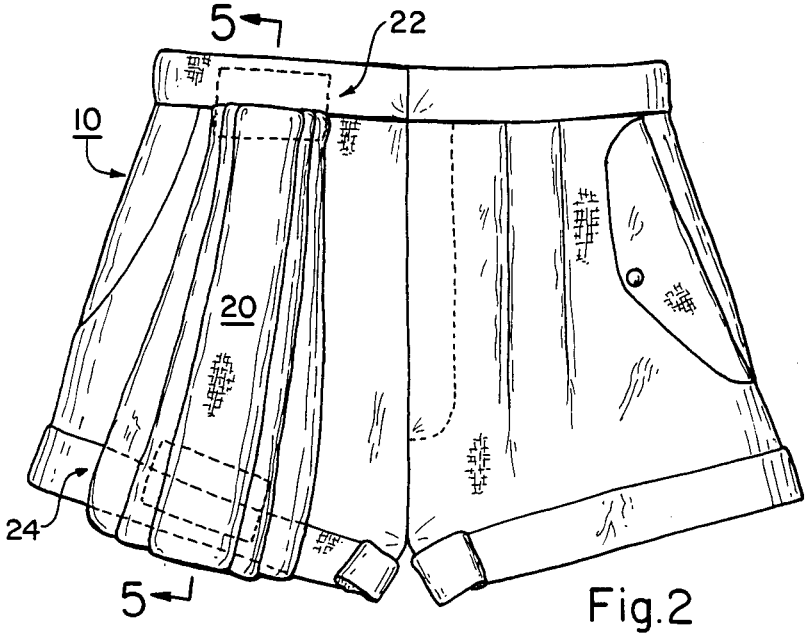
FIG. 2 is an elevational view of a pair of tennis shorts incorporating the inventive concepts described hereinafter.
Figure 5:
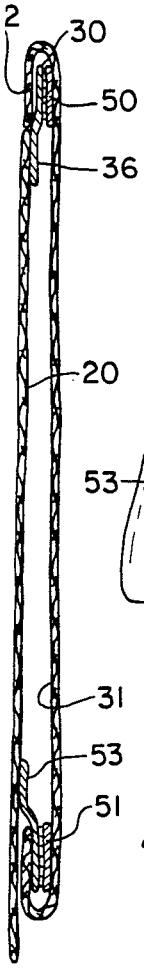
FIG. 5. is a longitudinal section through the tennis shorts and towel of FIG. 2 at plane 5,5.
Figure 6:
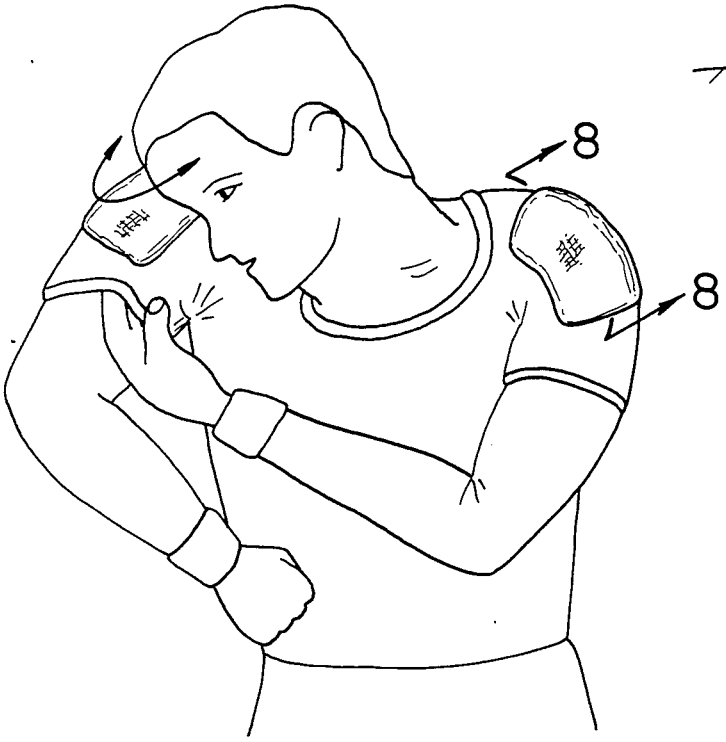
FIG. 6 is illustrative of the concepts of this invention as embodied in a sports shirt.
Figure 8:
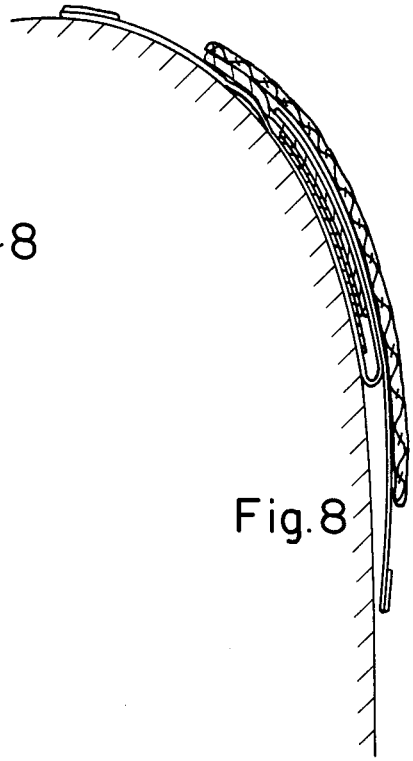
FIG. 8 is a longitudinal section through the sports shirt of FIG. 6 at plane 8,8.

FIGS. 1, 2 and 6.provide an illustration of the apparel concepts of this invention as embodied in a garment designed for the tennis court. The specific embodiment illustrated in FIGS. 1 and 2 is a pair of tennis shorts (10) with a towel (20) attached to the right front of the shorts at the waistband (22) and at the cuff line (24).

FIG. 2 is an illustration of the same tennis shorts as shown in FIG. 1 in an enlarged perspective view. As illustrated in FIG. 2, the towel is neatly positioned on the right front of the tennis shorts so as to permit ready access and yet not obstruct the pocket or otherwise interfere with play. In the embodiment of the invention illustrated in FIG. 2, the shorts are provided with a waistband (22) and also with cuffs (24) at the leg openings. In each instance the towel is secured to the apparel by a Velcro-like fastener (30, 32). The manner in which the towel is attached to the shorts is illustrated more fully in Figure 3.

Figure 3:
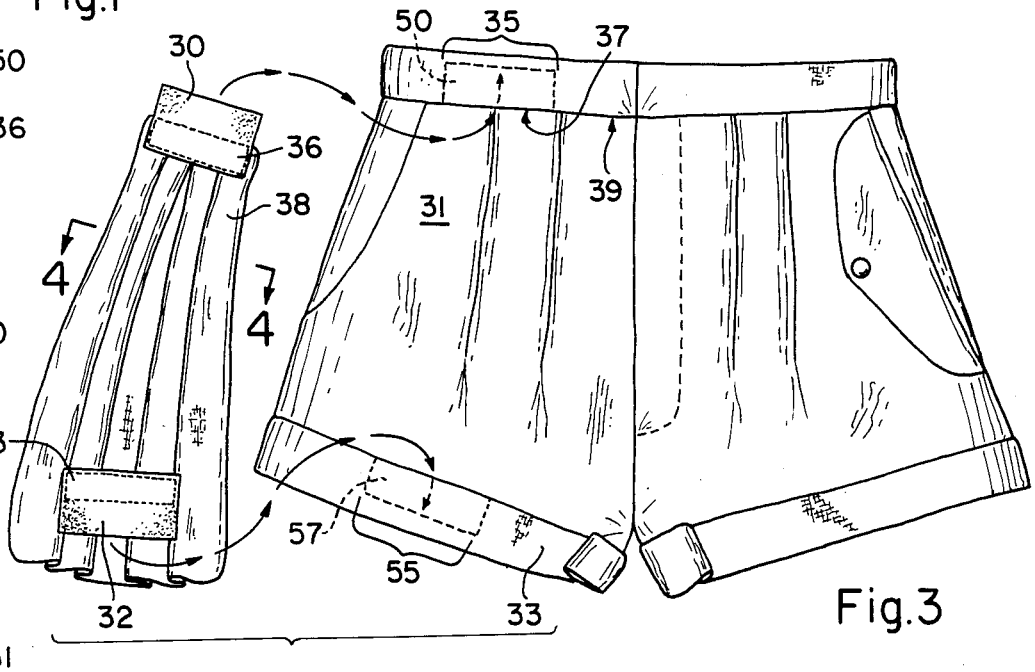
FIG. 3 is a perspective view of the tennis shorts of FIG. 2 with the towel having been removed.

As illustrated in FIG. 3, a Velcro-like mat (30) (loops) is permanently affixed to a tab (36) connected to the inside (38) of the towel. The relative position of the tab is such as to position the top of the towel at essentially the same height as the top of the waistband. The top of the towel is also deliberately gathered to provide a pleated appearance and, thus, afford towelling greater surface area in a more compact package. The method for attachment of the towel to sports apparel at the waistband, is by engagement of complimentary loops of the tab to a gripper means (50) concealed within an invisible pocket (35) at the belt line (22). As illustrated more fully by the dotted lines in FIG. 3, the gripper means (50) is concealed within the waistband and accessible through an opening (37) through a pocket in the waistband. The opening (37) of this pocket is coincident with the seam (39) which connects the waistband (22) and to the front panel (31) of the shorts.

In one of the preferred embodiments of this invention additional gripper means (51) are provided within the cuff (33) of the shorts. The gripper means are similarly concealed from view by placement within the cuff.

In this embodiment of this invention, the towel is preferably prepared with the material which inherently is attracted and held by the gripper means (57) within the cuff; or alternatively, provided with a second tab (53) near its base which can be inserted into this concealed pocket (55) This tab will preferably include complementary loops (32) for releasable engagement by the gripper means with the concealed pocket on this cuff. This dual attachment of the towel to the sports apparel prevents the towel from interference with the stroke of the racquet during play.

Figure 4:
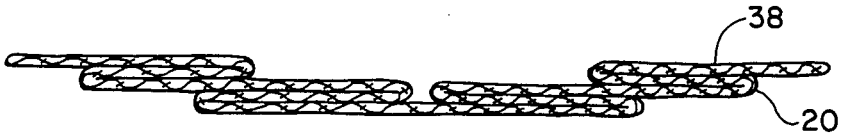
FIG. 4 is a cross-sectional view of the bowel of FIG. 3 at plane 4,4.

FIG. 4 is a cross-section through the towel at a point just below the point at which it has been gathered. This Fig. illustrates the pleating of the towel and thus the enhancement in surface area and appearance which it provides.

FIG. 6 is an adaptation of the inventions of this invention to a sports shirt. The towelling materials can be attached at the shoulder seam of the shirt.

Figure 7:
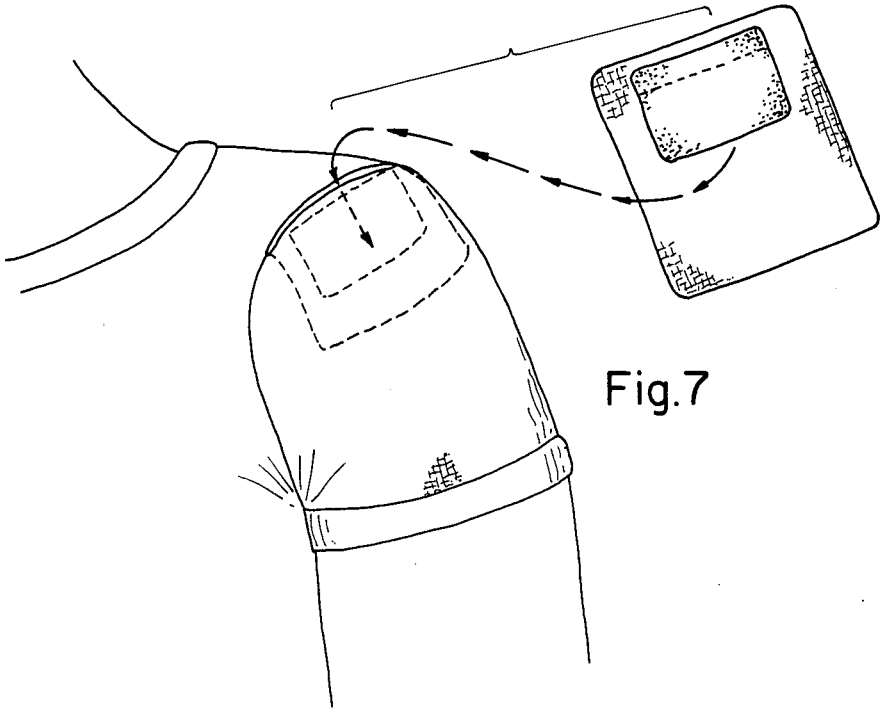
FIG. 7. is a partially exploded view of the shoulder of the sport shirt of FIG. 7 with the towel having been removed.

FIG. 7 is an adaption of the inventions of this invention to a sports shirt. The towelling materials can be attached at the shoulder seam of the shirt.

What is claimed is:

1. In a garment provided with gripper means for releaseable attachment of a towel to a panel of the garment, the improvement comprising:

a garment having a waistband and at least one panel thereof contiguous with the said waistband at a seam, said waistband comprising a facing component, a stiffening component and a fabric component, said fabric component being essentially the same or complimentary to the panel of the garment;

gripper means incorporated into the waistband as a partial replacement for a portion of the facing and/or stiffening, said gripper means being essentially completey concealed within the waistband and accessible through an opening in a seam between the waistband and a panel of said garment, said opening being essentially invisible to the casual observer and yet of sufficient size and shape to permit releaseable engagement by the gripper means of a complementary fastener which is attached to towelling means; and towelling means, said towelling having a top and a bottom, with the top thereof including said complementary fastener releasably attached to the gripper means incorporated into the waistband.

2. The improvement of claim 1, where the towelling means is further provided with a tab which is permanently attached near the top thereof, and the complementary fastener of the towelling means being incorporated into said tab.

3. The improvement of claim 1, wherein the garment is in the form of tennis shorts.

4. The improvement of claim 1, wherein the garment is in the form of a tennis skirt or dress.

5. The improvement of claim 1, wherein the garment is in the form of long pants.

6. The improvement of claim 1, wherein this garment is a component of an athletic uniform.

* * * * *